US005797290A

United States Patent [19]

Blissell et al.

[11] Patent Number: 5,797,290

[45] Date of Patent: Aug. 25, 1998

[54] CLOSED SYSTEM AND METHOD FOR SHOT PEENING ADJACENTLY LOCATED TUBES IN A POWER GENERATION SYSTEM

[75] Inventors: William H. Blissell, Elizabeth Township; David J. Fink, Greentree; David A. Snyder, North Huntingdon; Phillip J. Hawkins, Penn Hills Township, all of Pa.

[73] Assignee: Westinghouse Electric Corporation, Pittsburgh, Pa.

[21] Appl. No.: 193,771

[22] Filed: Feb. 9, 1994

Related U.S. Application Data

[63] Continuation of Ser. No. 850,543, Mar. 13, 1992, abandoned.

[51] Int. Cl.[6] ..... B23P 15/26; B24C 1/10; B24C 7/00; B24C 9/00

[52] U.S. Cl. ..... 72/53; 29/90.7; 29/727; 451/39

[58] Field of Search ..... 72/53; 29/90.7, 29/727; 451/39, 41

[56] References Cited

U.S. PATENT DOCUMENTS

| | | | |
|---|---|---|---|
| 3,199,171 | 8/1965 | Hellmann et al. | 72/53 |
| 3,425,250 | 2/1969 | Farris, Jr. et al. | 72/53 |
| 3,485,073 | 12/1969 | Burney | 72/53 |
| 3,485,074 | 12/1969 | Compton | 72/53 |
| 3,624,967 | 12/1971 | Kamper et al. | 72/53 |
| 4,300,318 | 11/1981 | Brown | 51/319 |
| 4,420,957 | 12/1983 | Weber | 29/90.7 |
| 4,614,100 | 9/1986 | Green et al. | 72/53 |
| 4,713,882 | 12/1987 | Bianchi et al. | 72/53 |
| 4,893,490 | 1/1990 | Isnardon et al. | 72/53 |

*Primary Examiner*—David Jones

[57] ABSTRACT

A shot peening system for peening the tubes of a steam generator continuously generates a shot stream and withdraws the shot stream dispensing nozzle into a vacuum chamber in an end effector while repositioning the nozzle for peening the next tube. A load tank forms an air lock for recycling shot recovered and cleaned by the vacuum system to a pressurized peen tank which feeds the recycled shot to a feed valve for mixing with a flow of compressed air to generate the shot stream. The pressure on the shot in the feed tank and the pressure of the compressed gas supplied to the feed valve are independently regulated to adjust the concentration of shot in the shot stream. The feed valve is constructed for ease of assembly and repair, and directs flow of a purge gas across the shot feed orifice and into a purge line which cycles shot and debris purged from the feed valve to the shot cleaning equipment on the vacuum side.

10 Claims, 6 Drawing Sheets

CLOSED SYSTEM AND METHOD FOR SHOT PEENING ADJACENTLY LOCATED TUBES IN A POWER GENERATION SYSTEM

This is a continuation of co-pending application Ser. No. 07/850,543, filed on Mar. 13, 1992, now abandoned.

BACKGROUND OF THE INVENTION

1. Field of the Invention

This invention relates to a system and method for shot peening tubes set into the tube sheet of a steam generator, and more particularly to a closed shot peening system and method which operate continuously.

2. Background Information

Steam generators for pressurized water nuclear reactors have thousands of U-shaped tubes set at both ends in bores in a thick steel tube sheet. The tube ends are fixed in the tube sheet by a tool which internally expands the tube wall radially outward in an expansion zone spaced from the end of the tube. Expansion transition zones are created at the ends of the expansion zone where the internal diameter of the tube transitions from the nominal inside diameter to the expanded inside diameter.

Primary water stress corrosion cracking (PWSCC) of steam generator tubes can reduce the availability of steam generators. One region which is susceptible to this cracking is the tube expansion transition zone.

After a steam generator is installed in a plant, one of the most effective means for minimizing tube expansion transition zone PWSCC is to reduce or modify the residual stress created when the tube was expanded during installation. Shot peening the inside surface of the steam generator tube modifies this residual stress and thus decreases PWSCC.

U.S. Pat. No. 4,713,882 discloses a shot peening system in which shot from a pressurized tank is entrained in a stream of compressed air and fed to a nozzle which is inserted successively into each of the tubes of the steam generator to be peened. The nozzle has a deflector which directs the shot radially outward at the tube wall. A brush confines the shot which is then scavenged by a vacuum system. The shot is withdrawn from the vacuum system through a line. The retrieved shot is weighed following the peening of each tube to determine that it has all been recovered. The system is turned off for repositioning the nozzle from one tube to the next. After about 10 to 15 tubes have been peened, the supply tank is depressurized, reloaded with shot and then repressurized. Thus, this is a batch process and sufficient shot must be loaded to fully peen a group of tubes. Actually, much more shot than is needed to peen the 10 to 15 tubes in each batch is required for proper operation of this system. Typically, about 200 pounds of shot is used. The same 200 pounds of shot can be used for peening all of the tubes in the steam generators. However, with the shot costing about $300 per pound, about $60,000 worth of shot is required. As the shot becomes contaminated during its use, it is discarded following peening of all of the tubes. The open system of this patent also increases exposure to the contaminated shot. In addition, the air discharged by this system contains contaminated dust and debris picked up by the system.

The system of U.S. Pat. No. 4,713,882 has a remotely operated tool holder which positions the tool, which includes the nozzle, successively in alignment with each of the steam generator tubes to reduce exposure of personnel to contamination present in the steam generator. The nozzle is connected to a supply conduit which is fed through an outer sheath to insert the nozzle into the tube to be treated. A mechanism located about 30 feet from the tube sheet outside the steam generator is used to feed the supply conduit. With this arrangement it is very difficult to position the nozzle at a desired location within the steam generator tube.

U.S. Pat. No. 4,893,490 assigned to the same assignee as U.S. Pat. No. 4,713,882 discloses a device into which the shot peening nozzle is withdrawn after each tube hammering operation to measure the effectiveness of the hammering with piezo electrical sensors.

The batch system of U.S. Pat. Nos. 4,713,882 and 4,893,490 are expensive in that a large amount of costly shot is required for each cycle. In addition, it is an open system in which shot is recovered and poured back into the system while exposed to the atmosphere. This permits oxides and other contaminated dust collected with the shot to be released. It is also time consuming, not only because the system must be stopped for recycling of shot, but also because of the time required to repressurize the system and fill up the supply conduit with a refreshed shot stream upon restart.

There is a need therefore for an improved method and apparatus for shot peening steam generator tubes with improved safety, reliability and efficiency.

More particularly, there is a need for a closed shot peening system and apparatus.

There is a further need for a faster, continuous shot peening process and system.

There is also a need for improved shot peening process and apparatus in which cause can be rapidly and efficiently cleared without opening the system.

SUMMARY OF THE INVENTION

These needs and others are satisfied by the invention which is directed to a closed system and apparatus for shot peening adjacently located tubes in a power generation system such as, for example, the tubes of a steam generator. A shot stream generator continuously generates a shot stream. A peening nozzle insertable into the steam generator tubes is connected to the shot stream generator to direct the shot stream against the interior walls of the tubes. Positioning means in the form of an end effector on a robotic positioner successively aligns the peening nozzle for insertion into each of the tubes. The nozzle is retracted into the positioning means between insertions into the tubes. The peening nozzle continues to discharge within the positioning means while being positioned for insertion into another tube so that the nozzle discharges the shot stream continuously. The vacuum system continuously collects shot discharged by the peening nozzle both into the tubes and into the positioning means. Means closed to the atmosphere returns shot collected by the vacuum means to the shot stream generator.

The shot peening system of the invention is safer in that it is a closed system so that the shot and collected debris are not open to the atmosphere. By recycling the shot in a continuous closed loop, much less shot, on the order of 20 pounds, is required compared to the 200 pounds required in prior art systems. In as much as this shot becomes contaminated and must be discarded following shot peening of the steam generator tubes, the novel system of the invention is much less costly.

The shot peening system of the invention includes screening means to separate debris from the shot in high efficiency particulate air filters to remove contaminated dust from the air utilized by the vacuum system.

Another aspect of the invention is control of the concentration of shot in the shot stream. This is achieved through independent regulation of the compressed gas stream fed to the shot steam generator and pressurization of the shot tank which feeds the shot to the feed valve of the shot stream generator.

The feed valve of the shot stream generator is also unique. It incorporates a purge system for cleaning out the orifice of the feed valve and recirculates the purge gas and purged shot back to the screening means in the vacuum system. More particularly, the feed valve has a tapered bottom wall leading to the shot feed orifice and a baffle which extends down toward the orifice which deflects the purge gas across the orifice. Preferably, shot is fed to the orifice through a feed passage in the baffle which is aligned with but, terminates short of the orifice.

Also preferably, the feed valve is an assembly of a housing in a valve body which can be easily and quickly disassembled and reassembled for cleaning and repair.

Also in accordance with the invention, the end effector which positions the peening nozzle in alignment with successive steam generator tubes, also incorporates a drive mechanism for advancing a shot stream supply hose to feed the nozzle into the steam generator tube. This positions the nozzle drive system adjacent the bottom of the tube sheet for more reliable tracking of nozzle position within the steam generator tube.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
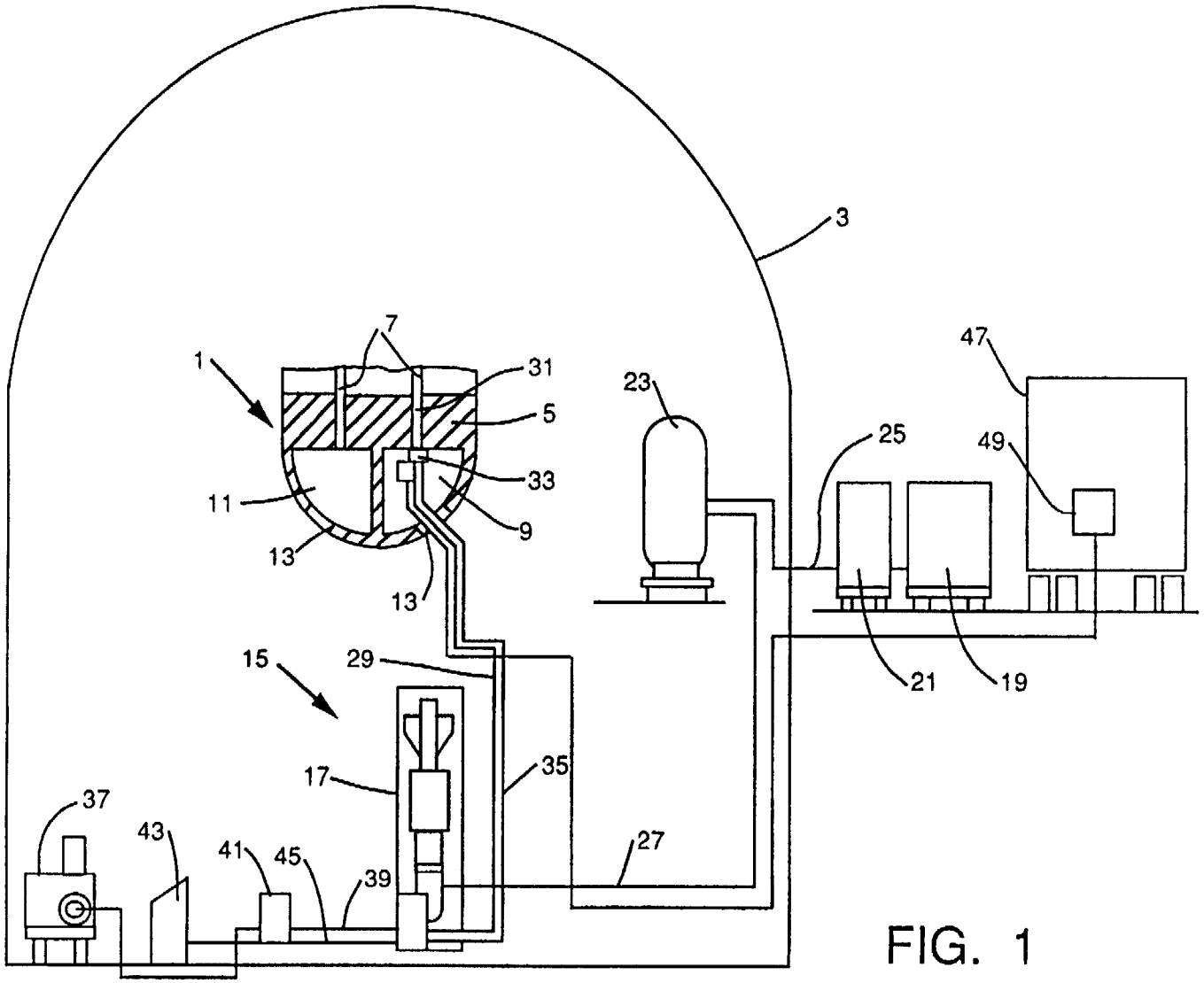
FIG. 1 is a schematic diagram of shot peening system in accordance with the invention.

The continuous shot peening system and method of the invention is used for servicing the steam generator of a pressurized water reactor power plant. FIG. 1 illustrates a portion of the steam generator 1 housed in containment 3. The steam generator 1 has a tube sheet 5 adjacent its lower end in which the ends of thousands of heat exchanger tubes 7 are secured. Beneath the tube sheet is a hemispherical chamber divided into an inlet side 9 and an outlet side 11. Access can be gained to the heat exchanger tubes 7 through manholes 13.

The shot peening system 15 of the invention is used to relieve primary water stress corrosion cracking (PWSCC) in the tubes 7. The shot peening system 15 includes a shot stream generator 17 which is positioned inside containment 3. Compressed air for the shot peening generator 17 is provided by an air compressor 19 located outside of containment 3. Compressed air generated by the air compressor 19 is passed through a dryer 21 and delivered to an air supply receiver tank 23 located inside containment 3 through a hose 25. The receiver tank 23, which serves as an accumulator, delivers compressed air to the shot stream generator through hose 27.

The shot stream generator 17 entrains shot in the flow of compressed air and delivers the resultant shot stream through a hose 29 to a nozzle 31 which is inserted into the tube 7 to be peened by an end effector 33. The shot stream is directed by the nozzle 31 against the interior wall of the tube 7. Spent shot is returned to the shot stream generator 17 through a vacuum line 35. As will be discussed in more detail, the shot stream generator 17 cleans the returned shot and recycles it for generating the shot stream in a completely enclosed loop.

Vacuum for the shot generator is provided by a vacuum pump unit 37 located inside containment 3 and connected to the shot stream generator 17 through a vacuum line 39. High efficiency particulate air (HEPA) filters 41 in the vacuum line 39 remove dust from the air drawn by the vacuum pump which can contain oxides and radioactive particles dislodged by peening the interior surfaces of the tubes 7.

The shot peening system 15 is controlled from a console 43 located inside containment 3 which is connected to the shot stream generator 17 by a pneumatic umbilical 45. For added safety, the operator can be located outside of containment, for instance in a service van 47, for remote control of the system through a remote control station 49.

Figure 2:
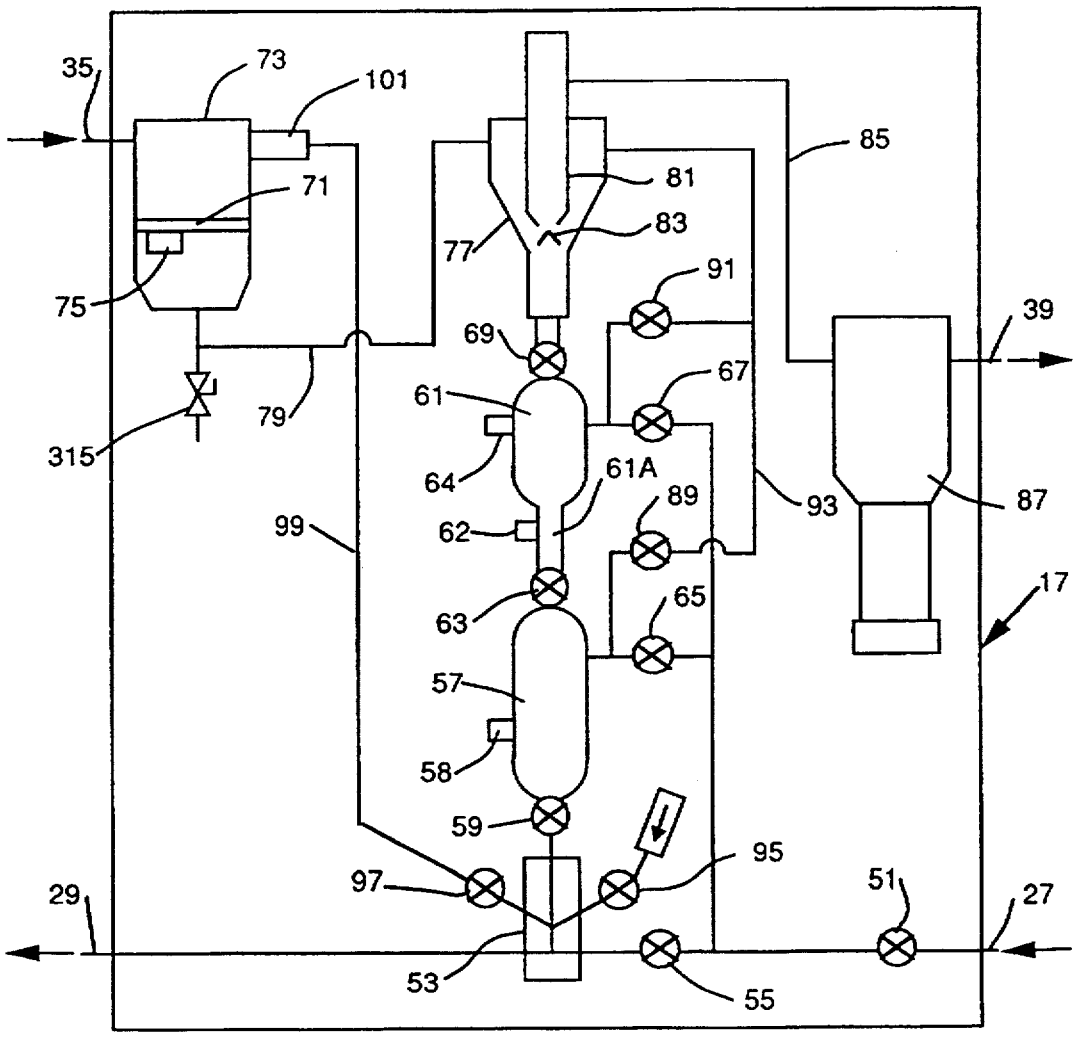
FIG. 2 is a schematic diagram of the shot stream generator which forms part of the shot peening system of FIG. 1.

The shot stream generator 17 is illustrated schematically in FIG. 2. The supply of compressed air delivered through the hose 27 is controlled by system pressure control valve 51. A flow of compressed air is delivered to a feed valve 53 through a peen air valve 55. The feed valve 53 feeds shot into the flow of compressed gas to generate the shot stream. The shot is provided to the feed valve 53 from a peen tank 57 through a inlet valve 59. The peen tank 57 in turn receives shot from a load tank 61 through a peen tank inlet valve 63. The peen tank can be pressurized through a peen tank control valve 65. Similarly, the load tank can be pressurized through a load tank control valve 67. The load tank has a load tank inlet valve 69.

Shot returned from peening of the steam generator tubes through the vacuum line 35 is passed through several units to separate the shot for recycling from debris dislodged in the shot cleaning process. First, the shot passes through a debris screen 71 in a screening unit 73. The debris screen 71 is vibrated by a vibrator 75. This unit removes any loose debris down to 400 microns from the shot. The shot next moves to a reclaimer/airwash unit 77 through line 79. The recovered shot enters the reclaimer/airwash unit 77 tangentially near the top of the unit. The vacuum is drawn through a cylindrical conduit 81 extending downward into the reclaimer/airwash unit. Shot falls downward onto a cone shaped baffle 83, and as it rolls downward over the baffle and into an outlet connected to the load tank inlet valve 69, it is washed by air drawn into the conduit 81. The conduit 81 is connected through a house 85 to a cyclone separator 87 which removes heavy dust and any minor carry-over of shot from the reclaimer/airwash unit 77.

The cyclone separator 87 is connected to the vacuum line 39 leading to the vacuum pump 37.

The peen tank 57 and load tank 61 can be be vented by peen tank vent valve 89 and load tank vent valve 91 into the reclaimer/airwash unit 77 through vent line 93. As described more fully below, the feed valve 53 can be purged by an air jet controlled by an air jet/ejector pump valve 95 which introduces a jet of air into the feed valve, and a purge valve 97 which directs the shot and debris purged from the feed valve through a line 99 back to the debris screen unit 73. An ejector pump 101 provides vacuum boost on the purge line 99.

The load tank 61 forms an air lock between the vacuum side of the continuous shot peening system and the pressure side while allowing continuous generation of the shot stream. The peen tank 57 is pressurized with compressed air supplied through the valve 65 for delivering shot to the feed valve 53. On the other hand, a vacuum is drawn in the reclaimer/airwash unit 77. The load tank 61 receives shot separated from the air stream by the reclaimer/airwash unit 77, and supplies it as needed to the peen tank 57. The load tank 61 therefore must be selectively isolated from, and connected to, the peen tank 57 and the reclaimer/airwash unit 77 alternately. The load tank 61 has a lower cylindrical section 61A which forms a graduate in which the amount of shot can be measured. A sensor 62 provides a signal when the shot reaches a predetermined level representative of a known volume. By measuring the time that the load tank takes to fill to the preset level, the flow rate of shot can be calculated. A second sensor 64 located in the upper part of the load tank indicates when the load tank is substantially full. A similar sensor 58 indicates when the level of shot in the peen tank reaches a preset level, such as a level indicating a need for recharging the peen tank with shot.

Figure 3:
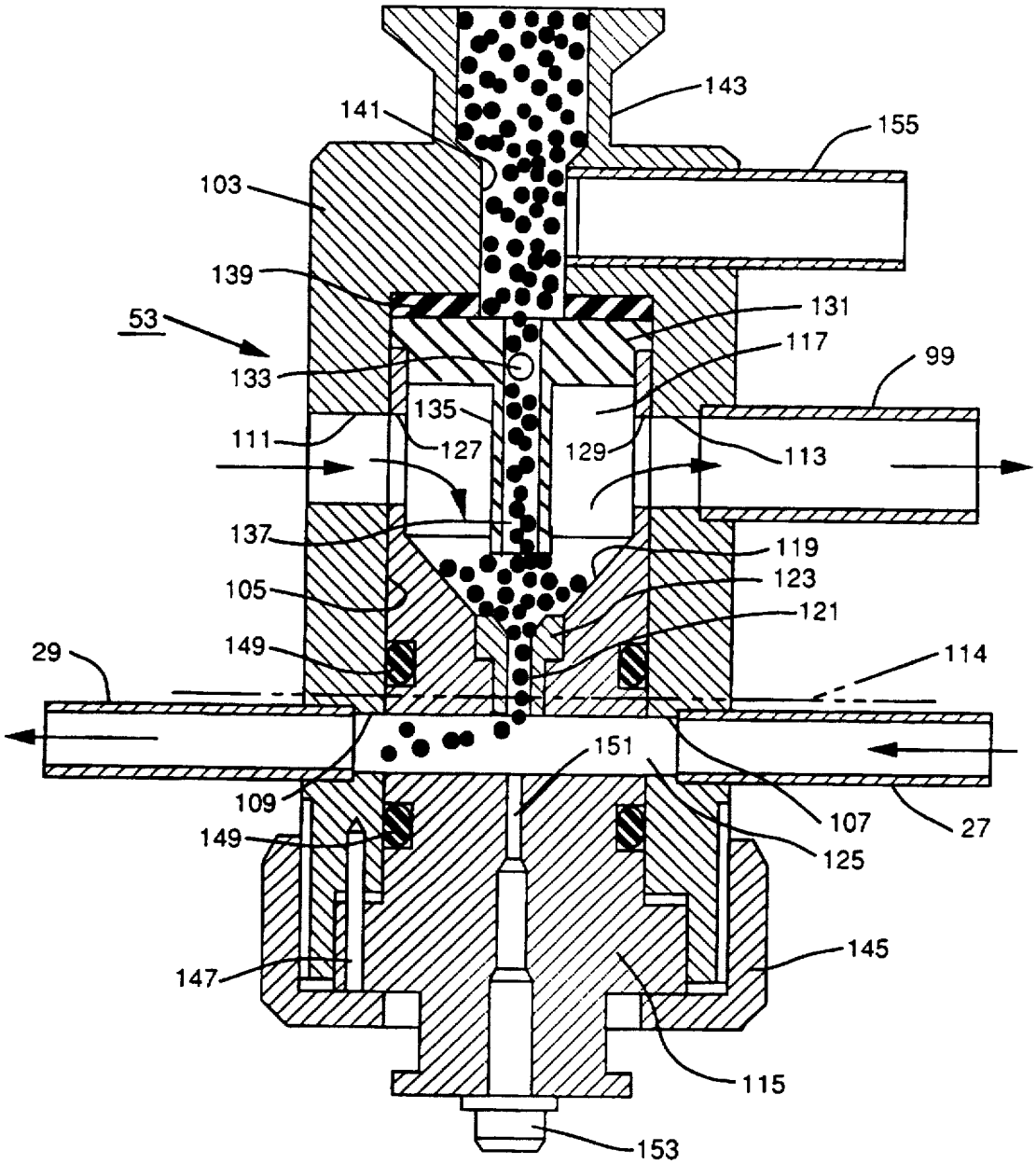
FIG. 3 is a vertical section through a feed valve which forms part of the shot stream generator of FIG. 2.

The feed valve 53 is shown in more detail in FIG. 3. The feed valve includes a cylindrical housing 103 with a blind bore 105 extending upward from the bottom. A pair of diametrically opposed radial bores 107 and 109 form peening gas inlet and outlet ports, respectively. A second pair of diametrically opposed radial bores 111 and 113 form purge gas inlet and outlet ports respectively in the housing 103. The portion of the feed valve 53 in FIG. 3 below the phantom line 114 is rotated 90 degrees for purposes of illustration. Thus, actually the peening gas ports are located 90 degrees to the purge gas ports.

The feed valve 53 further includes a cylindrical valve body 115 which slides into the bore 105 in the housing. The upper end of the valve body 115 forms a cylindrical chamber 117 with a conical bottom wall 119 tapering down to a chamfered orifice 121 in a replaceable insert 123 which extends between the chamber 117 and a transverse gas passage 125 aligned with the peening gas inlet and outlet ports 107 and 109. Purge gas inlet 127 connects chamber 117 with the purge gas inlet port 111, while a purge gas outlet 129 in the body 115 connects this chamber with the purge gas outlet port 113.

A rabbeted cylindrical cap 131 seats in the upper end of the valve body 115 to enclose the top of the chamber 117 and is held in place by a pin 133. An integral diametral baffle 135 extends axially downward from the cap 131 toward, but terminates short of, the orifice 121. A feed bore 137 aligned with the orifice 121 extends axially through the cap 131 and baffle 135, and also through a seal 139 between the cap 131 and the end of the bore 115. The feed bore 137 is aligned with an axial bore 141 in the housing 103 which extends upward through a neck 143 and through which shot is received from the peen tank 57.

The valve body 115 is secured in the bore 105 in the housing 103 by a cap nut 145 and is keyed for alignment of the various inlets and outlets with the ports in the housing 103 by a pin 147. The valve body is sealed within the housing 103 by a pair of O-rings 149 and the seal 139. An axial bore 151 in the valve body 115 is aligned with the orifice 121 to allow easy access to the orifice for cleaning without disassembling the valve. The bore 151 is plugged by the cap screw 153, but alternatively, a solenoid operated probe or a pneumatic ejector can be secured in the bore 151 for automatic remote cleaning of the orifice 121.

The shot from the peen tank 57 is fed down through the bore 141 in the housing 103 and the bore 137 into the chamber 117 where it is funneled down the conical bottom wall 119 into the orifice 121. The orifice 121 entrains the shot in the flow of compressed air supplied to the gas passage 125 through the inlet port 107 by the hose 27 from the compressor unit. The shot stream is discharged through the outlet bore 109 into the hose 29 for delivery to the nozzle for shot peening.

Should the shot become caked in the chamber 117, the feed valve 53 can be purged by introducing an air jet through the purge inlet 111. The baffle 135 deflects the purge gas stream downward underneath the baffle and along the conical bottom wall 119 toward the orifice 121. The purge gas dislodges the shot and any debris present and discharges it through the purge outlet 129 into the purge line 99. A sensor 155, such as a capacitive sensor, mounted in a bore in the housing 103 detects when the obstruction or blockage in the feed valve has been cleared by detecting the absence of shot in the bore 141.

The unique structure of the feed valve 53 provides a rugged reliable means for generating the continuous shot stream. Furthermore, the construction of the feed valve 53 permits it to be easily and quickly disassembled for replacement or repair. It also provides for automatic purging and clean out of the orifice without disassembling the entire valve.

Figure 4:
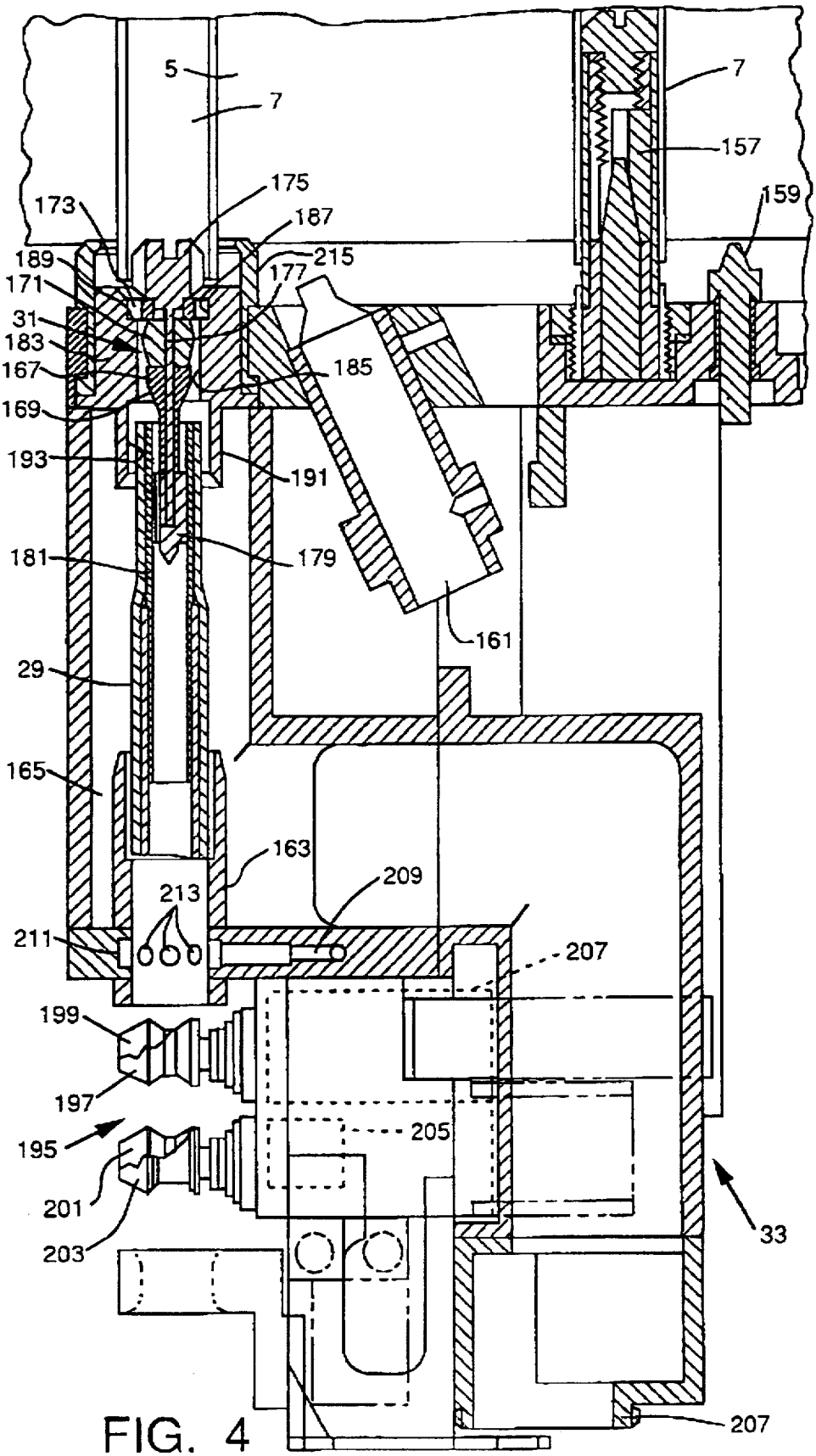
FIG. 4 is a vertical section through an end effector and shot peening nozzle forming part of the system of FIG. 1.

The shot stream generated by the shot stream generator in the feed valve 53 is delivered through the hose 29 to the nozzle 31. As previously mentioned, the nozzle is aligned with and fed into a tube 7 of the steam generator by the end effector 33. FIG. 4 illustrates in more detail the nozzle 31 and the pertinent parts of the end effector 33. The end effector has three three cam locks 157 (only one shown) which engage tubes 7 adjacent the tube to be inspected to support the end effector underneath the tube sheet 5. Standoff pins 159 (again, only one shown) help to level the end effector for axial alignment of the nozzle with the tube to be inspected and to space the end effector from the tube sheet. As is known in the art, the end effector can be remotely maneuvered under the tube sheet for successively aligning the nozzle 31 with each of the tubes to be inspected. A television camera 161 mounted on the end effector aids the operator in observing this alignment.

The hose 29 from the shot stream generator passes upward through a sleeve 163 into the end effector vacuum chamber 165. The nozzle 31 mounted on the end of the hose 29 includes a deflector 167 having a diverging cylindrical surface 169 which deflects the shot stream delivered axially from the hose 29 radially outward for peening the tube 7. A spacer 171 above the deflector 167 supports an annular brush 173 which forms a seal within the tube 7 to confine the shot, and also removes shot, oxides and other debris from the walls of the tube 7 as the nozzle is withdrawn. A finned centering head 175 above the brush 173 has a stem 177 which passes through the brush 173, the spacer 171 and the deflector 167 and screws into a spider 179 fixed within a metal sleeve 181 inside the free end of the hose 29.

At the upper end of the vacuum chamber 165 in the end effector is a peen stop 183 which has an axial bore 185. A chamfered counter bore 187 at the top of the peen stop forms a shoulder 189 with the bore 185. A collar 191 on the lower end of the peen stop 183 also has a chamfered counter bore 193. The nozzle 31 extends upward through the peen stop 183. The bore 185 is greater in diameter than the deflector 167 and the spacer 171 but smaller than the diameter of the brush 173 so that with the nozzle retracted into the end effector the brush 173 seats on the shoulder 189.

The nozzle 31 is extended into the tube 7 and retracted into the peen stop 183 by an integral drive unit 195 on the end effector. The drive unit includes a pair of horizontally spaced drive wheels 197 and 199 between which the hose 29 passes. A third drive wheel 201 clamps the hose 29 against an idler wheel 203 which drives an encoder 205. A motor 207 rotates the three drive wheels to feed the hose 29 and, therefore, the nozzle 31 into the tube 7.

Since the hose 29 is being driven directly in a straight line, from a short distance below the tube 7, and is guided by the sleeve 163 and peen stop 183, the encoder 205 can provide an accurate measure of the insertion of the probe into the tube 7.

The vacuum chamber 165 of the end effector is connected at its lower end 207 to the vacuum line 35. Shot discharged in a tube 7 during peening falls into the vacuum chamber 165 from which it is drawn by the vacuum through the vacuum line 35 to the shot stream generator 17 for recycling. Air is supplied to the vacuum system through a bore 209 in the end effector which communicates with an annular chamber 211 where it is distributed through apertures 213 into the sleeve 163. The air sucked by the vacuum system from between the sleeve 163 and the hose 29 prevents debris from lodging in this clearance and provides, in effect, an air bearing for the hose 29. A seal 215 is provided between the peen stop 183 and the bottom of the tube sheet around the tube being serviced.

The arrangement shown in FIG. 4 permits continuous generation of the shot stream. When peening of the tube 7 is completed, the nozzle is withdrawn into the shot peen stop 183 in FIG. 4 as shown so that the shot can be continuously discharged against the shot peen stop. With the brush 173 seated against the shoulder 189, all of the shot is contained within the shot chamber 165, and therefore, the end effector 33 can be positioned for alignment with the next tube to be peened without interruption of the shot stream.

Figure 5A:
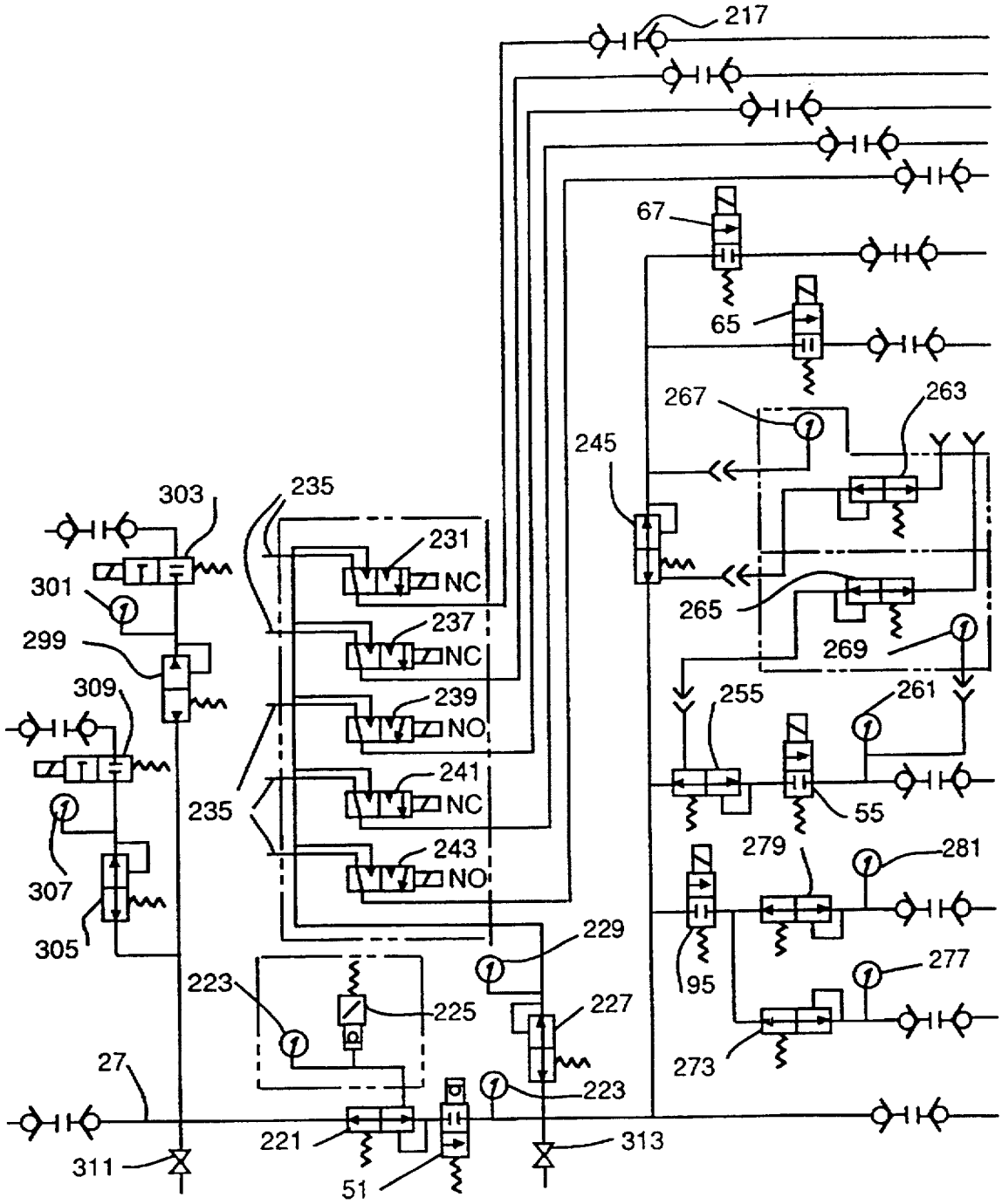
FIG. 5A and 5B when placed side by side illustrate a schematic diagram of a pneumatic system for the shot peening system of FIG. 1.
Figure 5B:
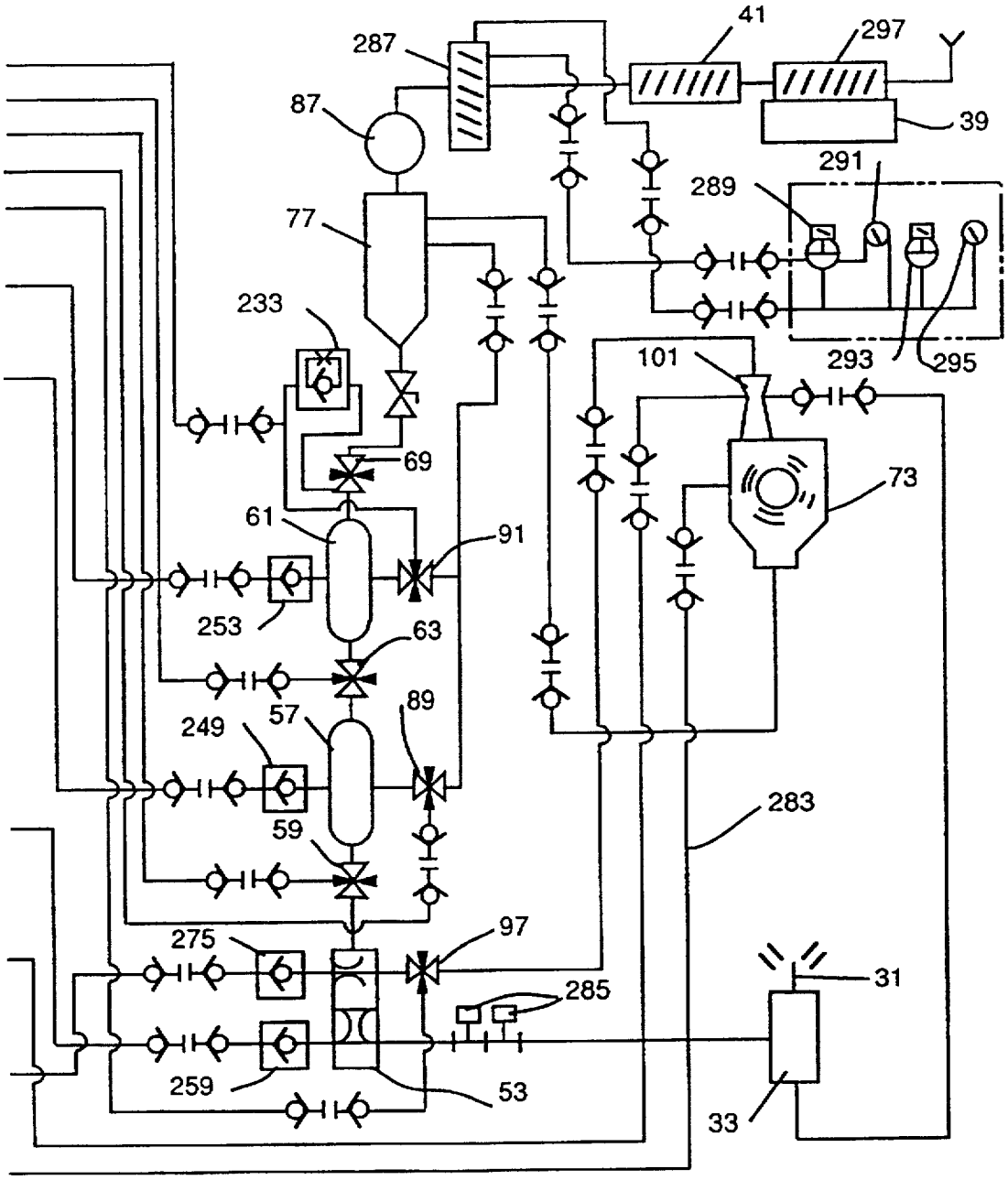

FIGS. 5A and 5B illustrate a schematic diagram of the pneumatic control system for the continuous shot peening system of the invention. The symbols 217 represent quick disconnects in the pneumatic lines. the pneumatic valves of the system are normally open and are closed by the application of pneumatic pressure. Controlled by solenoid valves. Except where noted, the solenoid valves are normally closed. The components shown within the phantom lines of FIG. 5 are located in the console 43 which is inside containment, but removed from the shot stream generator 17, as illustrated in FIG. 1. Compressed air received from the compressor over line 27 is admitted to the system by the solenoid operated system pressure control valve 51. System pressure is maintained by a regulator 221 and is indicated by system pressure gauges 223. System pressure switch 225 is actuated if system pressure exceeds a preset limit.

A control valve regulator 227 with a pressure gauge 229 supplies compressed air to a number of control valve solenoids. Solenoid 231 provides pneumatic pressure for operating the load tank inlet valve 69 and vent valve 91. A delay 233 delays opening of the load tank inlet valve until after the tank has been vented by opening of the vent valve 91. When the solenoid 231 is energized, both valves close at the same time.

A solenoid 237 controls opening of the peen tank inlet valve 63, while solenoid 239 controls the feed valve inlet valve 59, and solenoid 241 operates the peen tank vent valve 89. The purge valve 97 for the feed valve is operated by the solenoid 243. Solenoids 239 and 243 are normally open. When the solenoids 231, 237 and 241 are deenergized and when the solenoids 239 and 243 are engergized, the control pressure is dumped to the lines 235.

A unique feature of the invention is that the pressure feeding shot into the feed valve can be regulated independently of the pressure of the gas flow to the feed valve 51 for regulation of the concentration of shot in the shot stream. Accordingly, separate regulators regulate peen tank pressure and peen air pressure. Peen tank pressure, and load tank pressure, are regulated by the peen and load tank slave regulator 245. The solenoid operated peen tank control valve 65 controls pressurization of the peen tank 57 through a check valve 249, while solenoid operated load tank control valve 67 pressurizes the load tank 61 through check valve 253.

The pressure of the flow of gas supplied to the feed valve 53 for generation of the shot stream is controlled by the peen air slave regulator 255. Peen air flow is controlled by the solenoid controlled peen air valve 55 through the check valve 259. Ppeen air pressure can be monitored at the shot stream generator by observation of the gauge 261.

The peen and load tank slave regulator 245 and the peen air slave regulator 255 are remotely controlled from the console 53 by the peen and load tank pilot regulator 263 and the peen air pilot regulator 265, respectively. The respective pressures can be monitored at the console by the gauges 267 and 269.

Purging of the feed valve 53 is controlled by the solenoid operated air jet/ejector pump valve 95. An air jet regulator 273 controls pressure of the air jet provided to the feed valve through check valve 275. Air jet pressure can be monitored with the pressure gauge 277. An ejector pump regulator 279 controls the pressure of compressed air supplied to operate the ejector pump 101 which provides the vacuum boost for transferring purged shot from the feed valve to the screening unit 73. This pressure can be monitored by the gauge 281. The vibrator 75 in the screening unit is operated with compressed air supplied through the line 283 at system pressure. Shot stream flow to the nozzle 31 is monitored by redundant flow meters 285 on the downstream side of the feed valve 53.

As mentioned previously, a cyclone 87 removes heavy dust particles and any carry-over shot from the reclaimer 77. A primary filter 287 removes particles 10 microns and over. A delta P switch 289 monitors the pressure drop across this filter and is actuated to provide an indication of overloading of the filter if this pressure drop rises too high. A gauge 291 provides an indication of this pressure drop. A vacuum switch 293 is actuated if the vacuum in the system drops below a minimum value and vacuum pressure is measured by a gauge 295.

The HEPA filter 41 removes particles down to 0.3 microns from the gas flow in the vacuum system. To further remove particulates, a second HEPA filter 297 is provided on the vacuum pump 37.

The pneumatic systems also supplies air to the end effector seal through the bore 209, as mentioned above. This pressure is regulated by the air seal pressure regulator 299, monitored by the air seal pressure gauge 301, and controlled by the air seal control valve 303. System pressure is also provided to the cam locks 157 on the end effector. This pressure is controlled by the cam lock pressure regulator 305, is monitored by the pressure gauge 307, and controlled by the solenoid cam lock control valve 309. The entire pneumatic system can be purged by opening system purge valves 311 and 313.

In operation of the continuous peening system of the invention, the peen tank control valve 65 is opened to pressurize the peen tank 57, and the feed inlet valve 59 is opened to feed shot from the peen tank into the feed valve 53. The peen air valve 55 is also opened to supply the flow of compressed gas to the feed valve to 53 generate the shot stream.

The end effector 33 is positioned to align the nozzle 31 with the tube 7 to be peened. The motor 207 is then energized to feed the nozzle 31 up inside the tube 7. The nozzle 31 directs the shot stream against the tube walls to peen the inner diameter of the tube. The air seal control valve 303 is also open at this point to deliver a flow of compressed air into the sleeve 163 around the hose 29 to provide a seal and a flow of air for the vacuum system.

With the vacuum pump 37 operating, the spent shot which falls down into the vacuum chamber 165 is drawn through the hose 35 to the screening unit 73 which removes large debris from the shot as it passes through the screen 71. The screened shot then passes into the reclaimer/airwash unit 77, where it is separated from the gas flow and falls down through the open load tank inlet valve 69 into the load tank 61. At this stage, the peen tank inlet valve 63 is closed and the vent valve 91 for the load tank is open. The air and debris separated from the shot in the reclaimer/airwash unit 77 passes through the cyclone 87 which further removes large debris and any carry-over of shot. The vacuum flow then passes through the primary filter 287 and the two HEPA filters 41 and 297.

The time required for the recovered shot delivered by the reclaimer/airwash unit 77 to the load tank 61 to reach the level of the sensor 62 is measured to calculate the rate of flow of recycled shot. When the level of shot in the peen tank reaches the sensor 58, the solenoid 231 is energized to close the load tank inlet valve 69 and the load tank vent valve 91. The load tank control valve 251 is then operated to pressurize the load tank. Following this, the solenoid 237 is operated to open the peen tank inlet valve 63 to allow transfer of shot from the load tank 61 to the peen tank 57. Upon the completion of the transfer, the solenoid 237 is energized to close the peen tank inlet valve 63. The solenoid 231 is then deenergized to open the peen tank vent valve 91, and after a delay sufficient to permit depressurization of the load tank, to open the load tank inlet valve 69 to again collect recycled shot in the load tank 61. By continuously recycling shot in this manner, a smaller volume of shot is required. For instance, while the previous open system required 200 pounds of shot for proper operation, the exemplary embodiment of the invention requires only about 20 pounds of shot.

Through independent control of the peen air regulator 255 through the pilot regulator 265 and the peen and load tank slave regulator 245 through the pilot regulator 263, the pressure of the compressed gas flow to the feed valve 53 and the pressure assisted flow of shot to the feed valve can be independently regulated to regulate the concentration of shot in the shot stream.

When peening of the tube 7 is completed, the motor 207 on the end effector 33 is operated to retract the nozzle 31 into the end effector of vacuum chamber 165 as shown in FIG. 4. This permits the nozzle 131 to continuously discharge the shot stream without interruption as the end effector is repositioned into alignment with the next tube 7 to be peened. This saves time in that no delay is required to reestablish the shot stream throughout the system when transferring between tubes.

If it becomes necessary to purge the feed valve, the solenoid 239 is energized to close the feed valve inlet 59. The purge valve 97 is then opened by the solenoid 243 and the air jet and ejector pump are actuated by the solenoid 95. The air jet introduces a flow of compressed air into the chamber 117 in the feed valve 53 where it is deflected by the baffle 135 downward along the conical bottom surface 119 toward the orifice 121. This purged air then carries with it shot and debris up and out of the purge line 99 to the screen unit 77 with the assistance of the ejector pump 101. This system can also be used to download shot from the system by transferring shot from the load tank to the peen tank and opening the feed valve inlet 59. This transfers all the shot from the load tank and the peen tank back to the screening unit 77 where it can be downloaded through a valve 315.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A shot stream generator generating for a shot peening system a shot stream with a selected amount of shot entrained in a flow of gas said generator comprising:

a feed valve having an orifice through which shot is fed into a flow of gas;

a supply line supplying said flow of gas to said feed valve;

a shot tank delivering shot to said orifice in said feed valve; and pressure control means controlling pressure in said supply line and said gas pressure in said shot tank independently of each other to vary the concentration of shot in said shot stream.

2. A feed valve for generating a shot stream for a shot peening system, said feed valve comprising:

a shot feeding chamber, a gas passage having an inlet through which a flow of gas is received and an outlet through which said shot stream is discharged, an orifice between said shot feeding chamber and said gas passage between said inlet and outlet through which shot is introduced into said flow of gas, and purge means selectively directing a flow of purge gas through said shot feeding chamber and across said orifice.

3. The feed valve of claim 2 wherein said shot feeding chamber has a tapered bottom wall tapering to said orifice, a purge gas inlet, a purge gas outlet generally opposite said purge gas inlet, and baffle means directing purge gas flow along said tapered bottom wall between said purge gas inlet and purge gas outlet and across said orifice.

4. The feed valve of claim 3 wherein said baffle is directed at but terminates short of said orifice and has a shot passage therein feeding shot to said orifice.

5. The feed valve of claim 4 wherein said valve includes a housing having a cavity therein with a blind end and having gas stream inlet and outlet ports aligned on opposite sides of said cavity, a shot feeding port in said blind end of said cavity, and purge gas inlet and outlet ports, and a valve body incorporating said shot feeding chamber, orifice, said gas passage and said purge gas inlet and outlet, and slidable into said housing with said inlet and outlet of said gas passage aligned with said inlet and outlet ports respectively, said shot feeding port feeding shot into said shot feeding chamber and said purge gas inlet and outlet ports aligned with said purge gas inlet and outlet respectively.

6. The feed valve of claim 5 wherein said shot feeding chamber is open toward said blind end of said cavity in said housing and including a cover plate closing said chamber and carrying said baffle directed toward said orifice, said shot feeding passage through said baffle being aligned with said shot feeding port in said housing.

7. A method of shot peening adjacently located tubes of a power generation system comprising the steps of:

continuously generating a shot stream by entraining shot in a flow of pressurized gas;

continuously discharging said shot stream from a nozzle;

sequentially aligning said nozzle with, and inserting said nozzle into, said adjacently located tubes to be peened, without exposure to atmosphere;

continuously collecting shot discharged by said nozzle in said shot stream, including shot discharged while aligning said nozzle with said tubes; and recycling without exposure to atmosphere shot collected for said step of continuously generating a shot stream.

8. The method of claim 7 wherein said recycling comprises recycling a quantity of shot for generating said shot stream which requires multiple recyclings of shot to shot peen each tube.

9. The method of claim 7 wherein continuously generating a shot stream comprises applying gas pressure to said shot in a pressurizing chamber to feed said shot through an orifice into said flow of pressurized gas, wherein continuously collecting shot comprises scavenging shot with a vacuum, and wherein recycling shot comprises passing shot collected through an air lock between said vacuum and said pressurizing chamber.

10. The method of claim 7 wherein continuously generating a shot stream comprises applying gas pressure to said shot to feed said shot through an orifice into said flow of pressurized gas and regulating at least one of gas pressure applied to said shot and gas pressure of said flow of pressurized gas to regulate concentration of shot in said shot stream.

* * * * *